United States Patent [19]

Hiltner

[11] 4,280,091

[45] Jul. 21, 1981

[54] VARIABLE CURRENT SOURCE HAVING A PROGRAMMABLE CURRENT-STEERING NETWORK

[75] Inventor: David F. Hiltner, Portland, Oreg.

[73] Assignee: Tektronix, Inc., Beaverton, Oreg.

[21] Appl. No.: 89,067

[22] Filed: Oct. 29, 1979

[51] Int. Cl.[3] ..... G05F 1/44

[52] U.S. Cl. ..... 323/315

[58] Field of Search ..... 307/244, 251, 296; 323/4, 9

[56] References Cited

U.S. PATENT DOCUMENTS

| | | | |
|---|---|---|---|
| 3,943,431 | 3/1976 | Hareyama | 323/9 X |
| 3,947,704 | 3/1976 | Blauschild | 323/4 X |
| 3,982,172 | 9/1976 | Van De Plassche | 323/4 X |
| 3,986,101 | 10/1976 | Koetsch et al. | 323/4 X |
| 4,004,155 | 1/1977 | Nercessian | 323/9 X |
| 4,163,188 | 7/1979 | Culmer | 323/4 |

*Primary Examiner*—William M. Shoop

*Attorney, Agent, or Firm*—George T. Noe

[57] ABSTRACT

A variable current source having a programmable current-steering network is provided in which a plurality of field-effect transistors both provide current switching and form an integral part of the current source. This is accomplished by switching the field-effect transistors into and out of the feedback loop of a voltage follower, which in turn is connected to a current-setting resistor. Reference voltage for the current-setting resistor is provided by a variable voltage generator. The field-effect transistors are switched by means of a programmable digitally-switched bias generator circuit.

4 Claims, 1 Drawing Figure

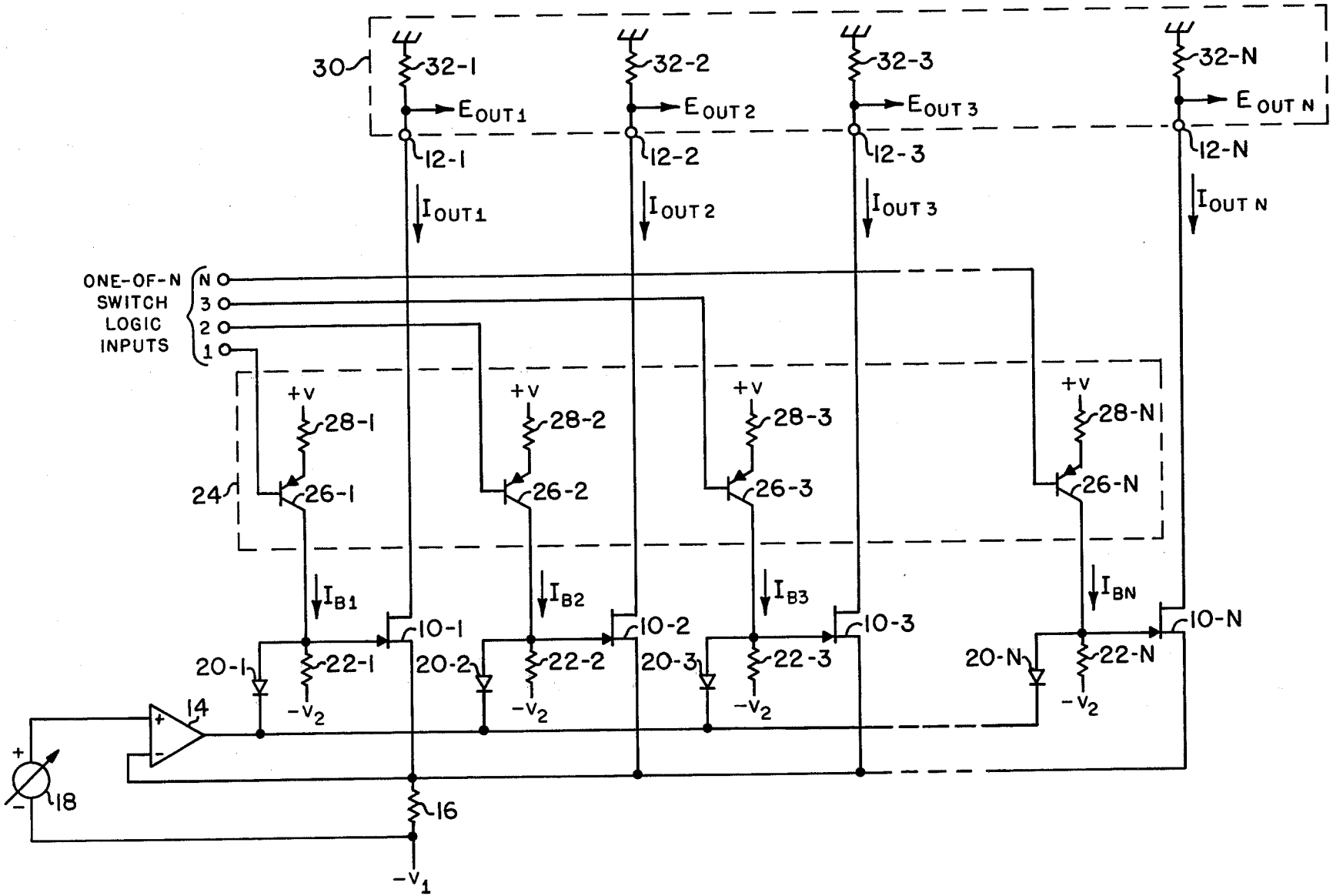
32-N
E OUT N
12-N
I OUT N
10-N
28-N
26-N
I BN
22-N
-V2
20-N
32-3
E OUT 3
12-3
I OUT 3
10-3
28-3
26-3
I B3
22-3
20-3
32-2
E OUT 2
12-2
I OUT 2
10-2
28-2
26-2
I B2
22-2
20-2
32-1
E OUT 1
12-1
I OUT 1
10-1
28-1
26-1
I B1
22-1
20-1
+V
30
24
14
16
-V1
18
ONE-OF-N SWITCH LOGIC INPUTS
N
3
2
1

VARIABLE CURRENT SOURCE HAVING A PROGRAMMABLE CURRENT-STEERING NETWORK

BACKGROUND OF THE INVENTION

Programmable current sources have wide application in electronic instruments for selectively providing current to various circuits or circuit components. One of the most common implementations of programmable current sources is to provide a separate current source for each output node, and this is a suitable arrangement as long as board size, power consumption, and actual current delivered are non-critical. However, in situations where high-accuracy, variable current is needed, it is most preferable to provide a single variable current source and steer the output current to the appropriate output node. Prior art implementations of this circuit have included a single field-effect transistor with source degeneration provided by a variable resistor, and multiple electro-magnetic relays in the drain circuit to provide the appropriate current steering. However, this circuit requires a large circuit board space, and consumes considerable power.

SUMMARY OF THE INVENTION

In accordance with the present invention, a variable current source having a programmable current steering network is provided in which a plurality of field-effect transistors (FET's) both provide current switching and form an integral part of the current source. An operational amplifier operated as a voltage follower is utilized to develop a variable reference voltage across a resistor to set the current therethrough. One of the aforementioned FET's is switched into the voltage follower feedback loop in such a manner that all of the current generated flows to an output port uniquely associated with the FET. In the preferred embodiment of the present invention, the selection of FET's is made by a plurality of digitally-switched, low-level current sources which provide enough bias current across a gate resistor to thereby generate a bias voltage to turn the particular FET on. The operational amplifier then robs current from this node to control the bias voltage at the gate of the FET. Power consumption of this circuit arrangement is substantially reduced over that of prior art arrangements, and the circuit may be implemented using miniature components to conserve circuit board space.

It is therefore one object of the present invention to provide a novel variable current source having a programmable current-steering network.

It is another object to provide a variable current source having a programmable current-steering network wherein a plurality of field-effect transistors both provide the current steering and form an integral part of the current source.

It is further object to provide a variable current source having a programmable current-steering network in which an operational amplifier voltage follower is utilized to develop a variable reference voltage across a resistor to set the current therethrough.

It is an additional object to provide a variable current source having a programmmable current-steering network which provides a savings of power consumption and circuit board space.

Other objects and advantages of the present invention will become apparent to those having ordinary skill in the art when taken in conjunction with the accompanying drawing.

BRIEF DESCRIPTION OF THE DRAWING

The single FIGURE is a schematic diagram of the preferred embodiment in accordance with the present invention.

DETAILED DESCRIPTION OF THE PREFERRED EMBODIMENT

In the single FIGURE, a schematic diagram of a variable current source having a programmable current-steering network is shown in which a plurality of FET's 10-1 through 10-N both provide current steering and, when activated, form an integral part of the current source in which the drains of the FET's present a high impedance to any load which may be connected to a plurality of current output nodes 12-1 through 12-N.

An operational amplifier 14 has the output thereof coupled through the selected FET to the inverting (−) input thereof to provide a voltage follower. A resistor 16 is the current-setting resistor for the current source, and is connected between the−input of amplifier 14 (and, hence, the sources of FET's 10-1 through 10-N) and a suitable source of supply voltage $-V_1$. A voltage generator 18 is connected between the non-inverting (+) input of amplifier 14 and the supply voltage $-V_1$ to set the voltage across resistor 16, and consequently set the current through resistor 16. Voltage generator 18 and resistor 16 may be variable by either electronic or manual methods, or may be programmable to produce predetermined voltage and resistance values respectively.

The output of amplifier 14 is coupled to the gates of FET's 10-1 through 10-N by diodes 20-1 through 20-N. Biasing resistors 22-1 through 22-N are connected to the respective gates of FET's 10-1 through 10-N. The selection of one of the FET's 10-1 through 10-N for activation, and hence, connection into the voltage follower fedback loop, is accomplished by a digitally-switched, low-level current source 24, which injects a current into one of the biasing resistors 22-1 through 22-N to develop a voltage thereacross to turn on the associated FET. The current source 24 comprises a plurality of transistors 26-1 through 26-N, the emitters of which are connected to a suitable source of supply voltage +V through respective current-setting resistors 28-1 through 28-N. These transistors and resistors may be fairly small in size, since the current generated is utilized only for the purpose of developing a biasing voltage for the FET's, and thus may be very low level. In fact, once the biasing voltage is developed, any excess current is conducted through the associated diode.

Switch logic signals are applied to the bases of transistors 26-1 through 26-N, which are shown as PNP type, to selectively digitally switch the current source 24. For this embodiment, a logic low will turn a transistor on while a logic high will turn a transistor off. A one-of-N logic signal is applied to ensure that only one of the transistors 26-1 through 26-N is turned on at a time.

As an example of the circuit operation, suppose that a logic low is applied to the base of transistor 26-1 while the bases of transistors 26-2 through 26-N are held high. Bias current $I_{B1}$ is injected into resistor 22-1, across which a bias voltage is developed to turn FET 10-1 and diode 20-on. The current generated by resistor 16 flows through FET 10-1 to output node 12-1 as output current $I_{OUT1}$.

An output circuit 30 is shown connected to the output nodes 12-1 through 12-N to provide an example of the type of circuit for which programmably-directed currents would be useful. Here, a plurality of resistors 32-1 through 32-N are connected between the respective output nodes 12-1 through 12-N and ground to provide a current-to-voltage converter. The resistor values of resistors 32-1 through 32-N may be chosen to provide different ranges of output voltages $E_{OUT1}$ through $E_{OUTN}$. Thus, by carefully selecting components and maintaining tight tolerances, an extremely high-accuracy calibration voltage generator may be fabricated. In a commercial embodiment of the present invention, a variable calibration voltage generator is provided in which the accuracy of output voltage is less than 0.25%.

It is to be understood that the above-described embodiment is merely illustrative of the principles of my invention; other arrangements or uses may be devised by those skilled in the art without departing from the spirit and scope of the invention.

What I claim is:

1. A current source for providing current to a plurality of output nodes, comprising:

a voltage follower comprising an operational amplifier having inverting and non-inverting inputs and an output, wherein said output is coupled to said inverting input to thereby provide an output loop;

a current-setting resistor connected to said inverting input;

a voltage generator connected to said non-inverting input to provide a reference voltage for said current-setting resistor;

a plurality of field-effect transistors switchable into and out of said output loop, said field-effect transistors being associated with respective ones of said plurality of current output nodes and being adapted to conduct substantially all of the current produced by said current-setting resistor; and means for switching said field-effect transistors into and out of said output loop.

2. A current source in accordance with claim 1 wherein said switching means comprises a plurality digitally-switched bias generators coupled to respective ones of said plurality of field-effect transistors, said bias generators being programmable to selectively switch only one at a time of said plurality of field-effect transistors into said operational amplifier output loop

3. A current source in accordance with claim 2 wherein each of said bias generators comprises a switched current source and a bias resistor connected to the gate of each of said field effect transistors.

4. A current source in accordance with claim 1 wherein said voltage generator is adjustable to provide a variable reference voltage for said current-setting resistor.

* * * * *